United States Patent [19]

Futch et al.

[11] Patent Number: 4,912,807

[45] Date of Patent: Apr. 3, 1990

[54] SLIDING DOOR/WINDOW TRACK ASSEMBLY

[76] Inventors: Clark R. Futch, 1406 S. Dogwood Dr.; Bobbie W. Futch, 1410 Cecil Rd., both of Nashville, Ga. 31639

[21] Appl. No.: 349,045

[22] Filed: May 8, 1989

[51] Int. Cl.[4] ..... A47H 1/04; A47H 15/00; E05D 13/02

[52] U.S. Cl. ..... 16/90; 16/95 R; 16/96 R; 49/404

[58] Field of Search ..... 16/90, 93 R, 95 R, 95 W; 49/404, 409

[56] References Cited

U.S. PATENT DOCUMENTS 4,823,511 4/1989 Herliczek et al. ..... 49/404

*Primary Examiner*—Richard K. Seidel

*Assistant Examiner*—Carmine Cuda

*Attorney, Agent, or Firm*—Harry I. Leon

[57] ABSTRACT

A sliding door/window track assembly particularly suited for use with thick glass. Fastenable directly to both the upper and lower edges of such glass, the assembly includes a frame member made of plastic. The frame member is suspended between a pair of guides formed within a track member. A plurality of keys, which ride in slots formed in the sides of the guides, are employed not only to suspend the frame member but also to lock it into the track member for security. Moreover, the track member also allows a large amount of foreign material to be deposited along the track before any interference with operation occurs. Further, the track assembly can be fabricated so that only plastic material rubs on plastic when the door/window is slid, thereby allowing for free movement with little friction.

5 Claims, 2 Drawing Sheets

SLIDING DOOR/WINDOW TRACK ASSEMBLY

BACKGROUND OF THE INVENTION

The present invention relates to doors or windows which are moved along horizontal tracks and more particularly to improved sliding track members.

Sliding doors which are supported mainly by overhead tracks were disclosed by Hermanson, U.S. Pat. No. 4,344,206. Hermanson recognized the need to have the tracks be alignable not only laterally but also longitudinally.

Vater, U.S. Pat. No. 4,457,046, like Hermanson, also taught the use of an overhead track for a sliding door panel or the like. To reduce friction between his track and the panel, Vater utilized an assembly of rollers with needle roller bearings to form a roller carriage assembly.

Shelton, U.S. Pat. No. 4,483,045, introduced a track having a rounded bottom along which a ball shaped roller moves. Shelton's ball-shaped roller is so mounted as to allow the door to be self-centering in the track.

The tracks and guides for sliding door in the prior art are mounted over the doors. Other means for restraining the doors is required to secure them along their lower edges. Furthermore, the prior art teaches the use of bearings to overcome friction forces generated while sliding the doors along their tracks.

SUMMARY

The objects and advantages of the present invention are achieved by a track assembly that is used to support both the upper and lower edges of a sliding door/window. The improved track assembly comprises a frame member, a track member and a plurality of keys. The frame member is rigidly attached to a sheet of glass or the like to form a door or window and is suspended within the track member by the keys. Each key is connected to the frame member and slideably engaged by the track member.

Both the frame member and the track member have transverse cross-sections which are approximately symmetrical. The frame member itself comprises an elongated structure with a three-sided plug which extends substantially the length thereof. The elongated structure also forms a trough, which is disposed between two side walls which project vertically in a direction away from the plug. The trough is sized so that the side walls fit snugly about the edges of the sheet of glass or the like.

The track member, on the other hand, includes a pair of vertical guides which are approximately mirror images of each other. Each of the guides has a horizontal slot formed on an inside wall of the track member. The two slots so formed oppose each other, providing a void of greater transverse width between the wall sections defining the slots than between any other wall sections of the guides situated either above or below the slots.

In use, the travel of the plug is limited by the guides between which the plug moves. The keys, which are spaced apart and pivotally connected to a single side of the plug, comprise means for suspending the frame member within the track member. Both ends of each key ride upon sections of the inner walls of the guides which define the two opposing slots. Contact between surfaces within the track assembly is minimized with such contact being only between the keys and the slots when the assembly is properly aligned. When the assembly is so aligned, the door/window of which the frame member is a part slides freely along the track member.

Means for adjusting the spacing between each key and the elongated plug is also provided, allowing the sliding door/window to be fitted to an opening. The adjusting means includes at least one washer which is used as a shim, the washer being secured between the plug and the key about the pivotal connection therebetween.

The use of the same track assembly to secure both the upper and lower edges of a sliding door is unique to the present invention. Moreover, the frame member and the track member are merely two shaped parts, that is, injection molded parts, which, together, with the keys can be put together in a simple manner. This means that this track assembly provides the basis for economical mass production.

Moreover, the frame member further comprises a side wall disposed horizontally from which the guides extend vertically. When the track assembly is used to secure the lower edge of the sliding door/window, the track member defines a void region below the opposing slots. This lower void region is provided so that foreign matter can accumulate there without having any effect upon the operation of the sliding door/window.

The track member, the frame member and the keys are preferably made of plastic material that has a low coefficient of friction. Such a material, unlike a bearing, does not need to be lubricated and is not subject to corrosion. Furthermore, since the elongated plug is inserted between the guides and since plastic has a low thermal conductivity, the improved track assembly has a lower heat loss than do track assemblies in the prior art. Finally, the streamlined modern appearances of the plastic track and frame member make the track assembly attractive even for use in commercial buildings.

DETAILED DESCRIPTION OF THE PREFERRED EMBODIMENT

Figure 1:
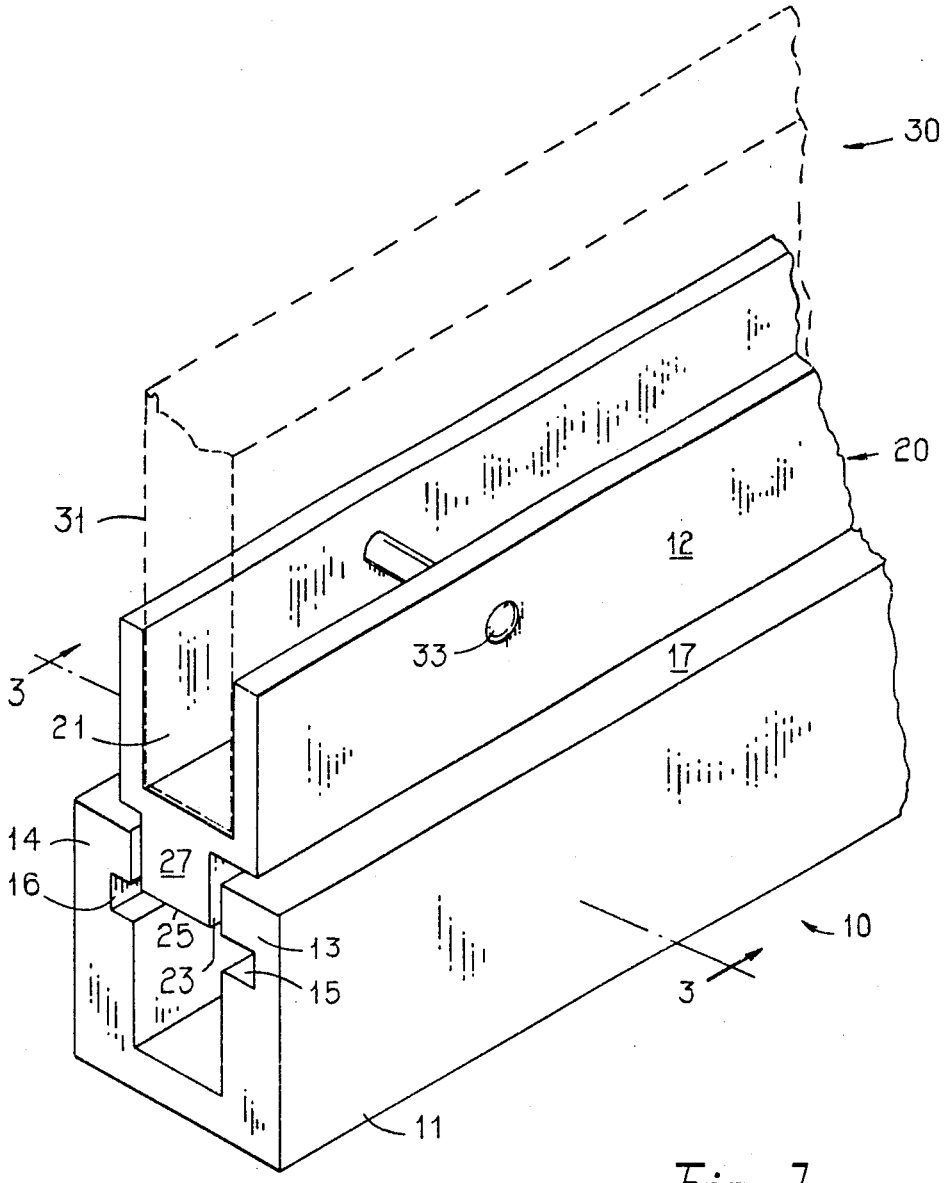
FIG. 1 is a perspective view of the lower track assembly in accordance with the present invention.

Referring to the drawings, a track assembly, indicated generally by the reference numerical 10, includes a track member 11 and a frame member 12. In use, the track member assembly 10 can be used both above and below a sliding door or window 30. An elongated sliding frame, as indicated generally by a reference numeral 20, includes the frame member 12. In the preferred embodiment, the frame 20 holds at least one sheet 31 of a glass or transparent plastic material. The sheet 31 is held within an elongated trough 21 formed in the frame member 12. The trough 21 extends the length of the edge of the sheet 31 with which the trough is contiguous. The trough measures, by way of example, ½ inch in width by ¾ inch in depth and is cut from stock material ¾ inch wide. Walls 18, 19, which are generally symmetrical in transverse cross-section, are each approximately ⅛ inch thick. At intervals along the sides walls 18, 19, holes 32 are formed. The holes penetrate the side walls 18, 19, and the sheet 31. Fasteners 33 which are inserted into the holes 32 secure the sheet 31 to the frame 20.

Figure 3:
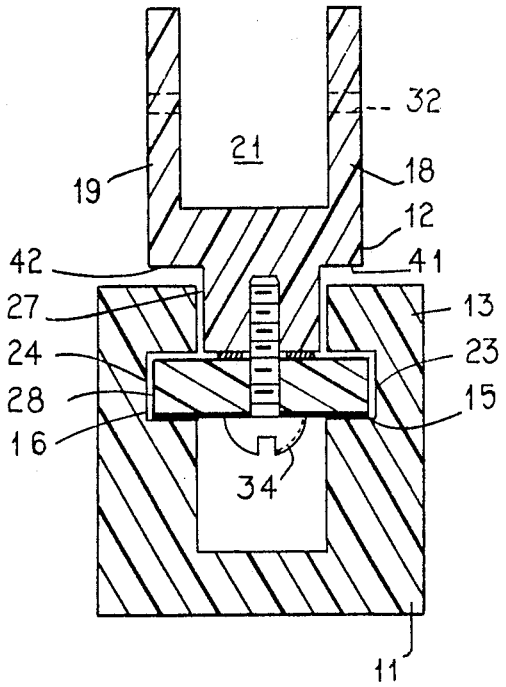
FIG. 3 is a cross-sectional view III—III according to FIG. 1.

The frame member 12 further includes a three-sided elongated plug 27. The plug 27 is disposed parallel to the trough 21 but projects away from it along the length of the frame member 12. In addition, a pair of shoulders 41, 42 are formed in the frame member 12 (FIG. 3). The shoulders 41, 42 are disposed generally symmetrically either on each side of the plug 27.

The frame member 12 is slideably movable in a longitudinal direction along the track member 11. To limit the side travel of the frame member 12, the track member 11, which is generally square U-shaped, includes a pair of guides 13, 14. The guides 13, 14, which are mirror images of each other, have elongated slots 15, 16, respectively, formed therein. In use, the plug 27 is situated between the guides 13, 14. A small clearance is maintained between the two vertical walls of the plug and the guides 13, 14, respectively (FIG. 3). A centrally-disposed third wall 25 of the plug 27 is spaced a considerable distance from the track member 11 and remains out of contact therewith as do the two shoulders 41, 42 (FIG. 3).

Means for suspending the plug 27 between the guides 13, 14 comprises a plurality of keys 28. Each key 28, which is generally of a rectangular shape, is pivotally attached to the plug 27 by a screw 34 which is threadably engageable therewith. The keys 28 not only support and center the frame member 12 within the track member 11 but also slideably lock the frame member to the track member. To minimize contact between the keys 28 and the track member 11, the keys are positioned at widely-spaced intervals along the plug 27. In the preferred embodiment, the keys 28 measure, by way of example, only 2 inches in length and are placed at intervals of about 18 inches apart.

The track member 11 may be fabricated from a solid in the shape of a rectangular prism of either a plastic or metal material. Alternately, the track member 11 can be extruded. In the preferred embodiment, the track member 11 is formed of a plastic that has a low coefficient of friction such as polyethylene, polypropylene, nylon or the like.

For a wide range of applications, the track member 11 may be fabricated from a solid having a square cross-section which measures, by way of example, 1.25 inches on a side. In such a case, two cutting operations are preformed parallel to the longitudinal axis of the solid to form the track member 11. In the first cut, a deep groove which is approximately centered in one of the faces of the solid and which extends over half way through it is created. The groove measures, by way of example, approximately ½ inch in width and ⅞ inch in depth. In a second cut, a slot ¼ inch is made perpendicular to the groove and less than half way from the cutting surface. In the preferred embodiment, each of the slots 14, 15 measures, by way of example, is 5/16 inch in width and is formed ¼ inch from the surface 17. When the track member 11 is made from an extruded material, both the groove and the slots are formed simultaneously in the extrusion process.

Figure 2:
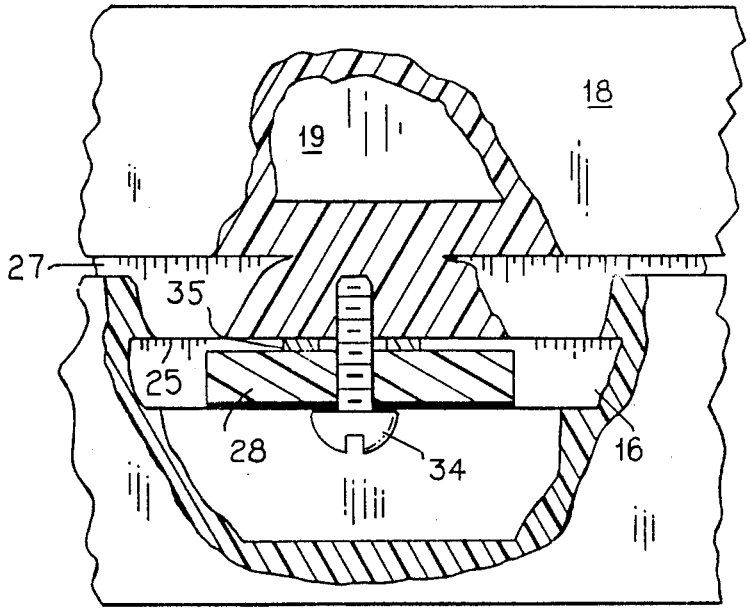
FIG. 2 is a broken out side elevational view of the lower track assembly according to FIG. 1.

To aid in fitting the combination sliding door 30 and track assembly 10 into an opening, shim washers 35 may be inserted on the screw 34 between the keys 28 and the plug 27 (FIG. 2). The track assembly 10 and door 30 are assembled and adjusted as required while both the assembly and the door are resting on a horizontal surface. Subsequently, they are raised into position and then secured within the opening.

It is apparent from the foregoing that a new and improved track assembly for use in sliding doors and windows has been provided. While only the presently preferred embodiment of the invention has been disclosed, as will be apparent to those familiar with the art, certain changes and modifications can be made without departing from the scope of the invention as defined by the following claims.

It is claimed:

1. A track assembly for slideably supporting a sheet of material for a door comprising:

(a) an elongated track member, each transverse cross-section thereof being approximately symmetrical; the track member including a first side wall which is disposed horizontally and a pair of guides which extend vertically therefrom; the guides being substantially mirror images of each other and spaced apart; the first side wall and the guides comprising a first single, unitary piece formed of plastic;

(b) each guide having an opposing elongated slot which is disposed horizontally;

(c) a frame member, each transverse cross-section thereof being approximately symmetrical; the frame member including a second side wall which is disposed horizontally and above the guides of said track member and a three-sided plug which extends vertically therefrom the plug extending substantially the length of the frame member; the frame member having third and fourth side-walls which extend vertically from the second side wall in a direction away from the plug, the second, third and fourth side walls forming a trough into which an edge of the sheet of material can be inserted; the plug being movable between the guides; the second, third and fourth sidewalls comprising a second single, unitary piece formed of plastic; and (d) a plurality of keys, each key being generally rectangular in shape and pivotally connected to a single side of the plug; contiguous pairs of keys being spaced apart; the ends of each key riding in the opposing slots.

2. The track assembly according to claim 1 wherein the second side wall is further characterized as being spaced apart from each of the slots by a distance substantially equal to the distance the plug extends vertically; the track member, when used to secure the lower edge of the sheet of material, defining a void region below the opposing slots, so that foreign matter can accumulate in the void region without having any effect upon the operation of the door.

3. The track assembly according to claim 1 which further comprises means for adjusting the spacing between each key and the plug, the adjusting means including at least one washer, the washer being secured between the plug and the key about the pivotal connection therebetween.

4. In a horizontally slideable structure having a sheet of material mounted within a frame member which is movable along a track member, the improvement comprising:

(a) an elongated track member that an be mounted above as well as below the door; each transverse cross-section of the track member being approximately symmetrical; the track member including a first side wall which is disposed horizontally and a pair of guides which extends vertically therefrom;

the guides being substantially mirror images of each other and spaced apart; the first side wall and the guides comprising a first single, unitary piece formed of plastic;

(b) each guide having an opposing elongated slot which is disposed horizontally;

(c) a frame member, each transverse cross-section thereof being approximately symmetrical; the frame member including a second side wall which is disposed horizontally and above the guides of said track member and a three-sided plug which extends vertically, the plug extending substantially the length of the frame member; the frame member having third and fourth side walls which extend vertically from the second side wall in a direction away from the plug, the second, third and fourth side walls forming a trough into which an edge of the sheet of material can be inserted; the plug being movable between the guides; the second, third, and fourth side walls comprising a second single, unitary piece formed of plastic; and (d) a plurality of keys, each key generally rectangular in shape and pivotally connected to a single side of the plug; pairs of keys being spaced apart; the ends of each keys riding in the opposing slots.

5. The improvement according to claim 4 which further comprises means for adjusting the spacing between each key and the plug, the adjusting means including at least one washer, the washer being secured between the plug and the key about the pivotal connection therebetween, so that the horizontally slideable structure can be fitted to the opening.

* * * * *